US007357139B2

(12) United States Patent
Bonin, Jr.

(10) Patent No.: US 7,357,139 B2
(45) Date of Patent: Apr. 15, 2008

(54) STAIR-ADJUSTABLE CRUTCH

(76) Inventor: Henry K. Bonin, Jr., 3159 Wilcox Ave., Memphis, TN (US) 38111

( * ) Notice: Subject to any disclaimer, the term of this patent is extended or adjusted under 35 U.S.C. 154(b) by 417 days.

(21) Appl. No.: 11/064,272

(22) Filed: Feb. 23, 2005

(65) Prior Publication Data

US 2005/0189008 A1 Sep. 1, 2005

Related U.S. Application Data

(60) Provisional application No. 60/547,672, filed on Feb. 26, 2004.

(51) Int. Cl.
*A61H 3/02* (2006.01)

(52) U.S. Cl. ..... 135/68; 135/69; 135/74; 135/84; 248/514; 248/188.8

(58) Field of Classification Search ..... 135/65–66, 135/68–70, 74, 80, 84, 78; 248/155, 155.5, 248/122.1, 514, 188.8, 408–409, 520, 538
See application file for complete search history.

(56) References Cited

U.S. PATENT DOCUMENTS

| | | | | | |
|---|---|---|---|---|---|
| 1,090,960 | A | * | 3/1914 | Appleman | 135/70 |
| 2,674,253 | A | * | 4/1954 | Hopkins | 135/69 |
| 2,771,089 | A | * | 11/1956 | Magida | 135/69 |
| 3,034,524 | A | * | 5/1962 | Klino | 135/69 |
| 3,301,268 | A | * | 1/1967 | Tryon | 135/69 |
| 3,886,962 | A | * | 6/1975 | Diamontis | 135/69 |
| 4,141,375 | A | * | 2/1979 | Tykwinski | 135/66 |
| 4,364,405 | A | * | 12/1982 | Norwood et al. | 135/70 |
| 4,386,466 | A | * | 6/1983 | Lee | 33/515 |
| 4,527,579 | A | * | 7/1985 | Knotter et al. | 135/74 |
| 4,763,680 | A | * | 8/1988 | Acosta, Sr. | 135/68 |

(Continued)

FOREIGN PATENT DOCUMENTS

JP 2003334220 A * 11/2003

OTHER PUBLICATIONS

I walk free internet advertisement for hands-free crutch Jul. 20, 2003.

*Primary Examiner*—Winnie Yip

(57) ABSTRACT

A stair-adjustable crutch characterized by an adjusting cuff having a cone with an elongated or extended, flared and offset lip and lip receptacle provided in the crutch foot to facilitate selective angular adjustment of the crutch foot and frame from an aligned configuration. This adjustment is effected by manipulation of a rod fitted with a pair of spaced-apart, wishbone-shaped legs extending into the cone, which legs are provided with shaped tabs or locks for selectively entering and exiting spaced-apart sets of vertical and angled slots in the cone of the adjusting cuff. Up and down movement of the adjusting rod facilitates both selective conventional operation of the crutch with the crutch foot in linear alignment, and angling of the crutch frame and upper crutch foot at the adjusting cuff with respect to the crutch foot below the adjusting cuff, to adjust the user's weight and more safely ascend and descend steps and stairs. A method for angularly adjusting a crutch frame and upper crutch foot with respect to the lower crutch foot by providing an adjusting cuff having a cone with an elongated, flared lip and lip receptacle in the crutch foot and a rod and lock mechanism that interacts with the adjusting cuff to facilitate more safely climbing and descending steps and stairs.

17 Claims, 4 Drawing Sheets

U.S. PATENT DOCUMENTS

| | | | | | |
|---|---|---|---|---|---|
| 4,865,064 | A | * | 9/1989 | Parsons et al. | 135/68 |
| 5,056,546 | A | * | 10/1991 | Sharp | 135/68 |
| 5,313,971 | A | * | 5/1994 | Upshaw | 135/68 |
| 5,351,701 | A | * | 10/1994 | Hsiao | 135/68 |
| 5,402,811 | A | * | 4/1995 | Weng | 135/68 |
| 5,458,143 | A | | 10/1995 | Herr | 135/68 |
| 5,465,745 | A | | 11/1995 | Davis | 135/82 |
| 5,649,558 | A | | 7/1997 | Richard | 135/67 |
| 5,746,236 | A | * | 5/1998 | Tilsley et al. | 135/66 |
| 5,765,583 | A | * | 6/1998 | Gamper | 135/68 |
| 6,055,998 | A | * | 5/2000 | Bader | 135/69 |
| 6,453,921 | B1 | | 9/2002 | Rost | 135/67 |

* cited by examiner

STAIR-ADJUSTABLE CRUTCH

CROSS-REFERENCE TO RELATED APPLICATIONS

This application claims the benefit of and incorporates by reference prior filed U.S. Provisional Application Ser. No. 60/547,672, filed Feb. 26, 2004.

SUMMARY OF THE INVENTION

This invention relates to crutches and more particularly, to a step and stair-adjustable crutch which is characterized by a crutch frame having a bisected crutch foot fitted with an adjusting cuff. The crutch frame and upper crutch foot segment are pivotally carried by the adjusting cuff for selective linear and angular adjustment of the frame and upper crutch foot segment with respect to the typically solid or plugged lower segment of the crutch foot, which is fixed to the adjusting cuff. The adjusting cuff is characterized by a generally cylindrical base fixed to the lower crutch foot and extended to define an upper elongated, flared or offset lip and lip receptacle cuff cone. Spaced-apart foot-alignment slots and foot angulation slots are provided in the cuff cone for selectively aligning with corresponding lock slots in the upper crutch foot segment and receiving a pair of rounded or tapered tabs or locks provided on oppositely-disposed, wishbone-shaped, resilient legs extending from the bottom end of an adjusting rod that is slidably disposed in or beside the upper crutch foot. The adjusting rod is typically terminated at the top end by a handle. Up and down manipulation of the adjusting rod facilitates engagement of the locks in the lock slots and selective engagement of the locks in the foot alignment slots and foot angulation slots for operation of the crutch in conventional fashion on flat surfaces with the crutch frame and the upper and lower crutch foot locked in substantially aligned orientation, and pivotal angulation of the crutch frame and upper crutch foot with respect to the lower crutch foot, for climbing and descending steps and stairs. Pivoting movement of the crutch frame is thusly facilitated at the cuff cone of the adjusting cuff, since the cylindrical cuff bottom is fixed to the lower segment of the crutch foot.

The first pair of oppositely-disposed foot alignment slots provided in one segment of the cuff cone are linearly aligned with the fixed lower crutch foot segment, while the second pair of oppositely-disposed foot angulation slots are angled with respect to the foot alignment slots and are located in the offset or flared lip receptacle portion of the cuff cone. The adjusting rod extends from the handle beneath the grip on the crutch frame downwardly, typically through a longitudinal bore or opening in the crutch foot, near or into the cuff cone. The top segment of the crutch foot typically pivotally mounts in the cuff cone of the adjusting cuff on a crutch pivot pin or bolt and may be bevelled to engage the fixed lower crutch foot segment and provide additional structural stability. The pair of resilient rod legs extends from the bottom end of the adjusting rod, typically in a wishbone configuration, into the irregularly-shaped cuff cone and each leg is provided with a tab or lock having at least a top curve or taper and preferably, also a bottom curve or taper. This design facilitates selective engagement of the tabs or locks with the respective companion lock slots in the top crutch foot segment and the corresponding spaced-apart aligned cone slots and angled cone slots, depending upon whether the crutch is to be used in the conventional mode on substantially flat or level ground with an aligned crutch foot and frame, or for climbing and descending steps or stairs with the crutch foot pivoted in angulated mode to facilitate adjustment of the user's weight into a safer step-traversal position. Accordingly, the crutch frame and pivotally bisected foot are designed to be oriented in a substantially vertical configuration while the crutch is used in conventional manner and the crutch frame pivoted into the angulated configuration with respect to the crutch foot for climbing and descending steps or stairs.

BRIEF DESCRIPTION OF THE DRAWINGS

The invention will be better understood by reference to the accompanying drawings, wherein.

DESCRIPTION OF THE PREFERRED EMBODIMENTS

Figure 1:
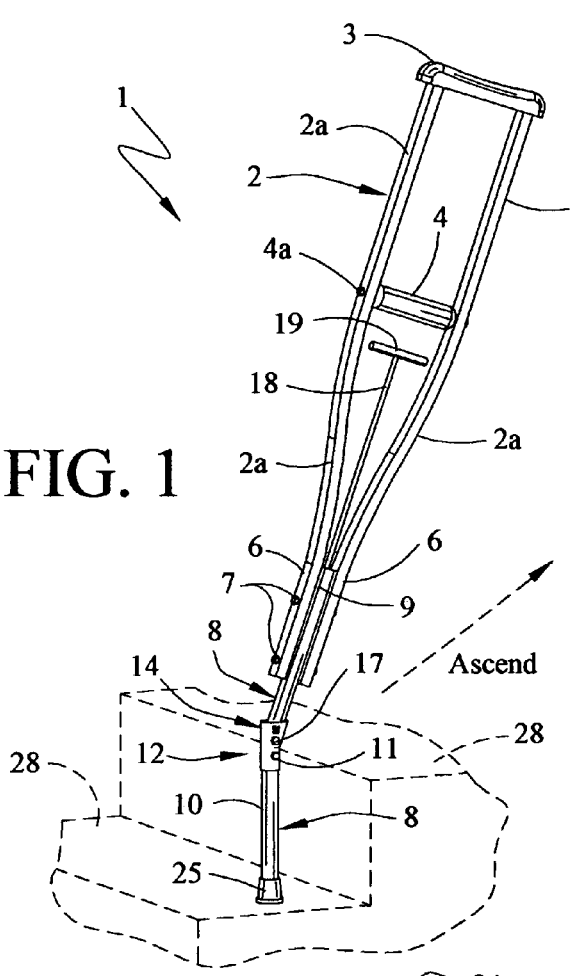
FIG. 1 is a perspective view of a preferred embodiment of the stair-adjustable crutch of this invention, with the crutch frame angulated in position to ascend a set of steps or stairs.
Figure 2:
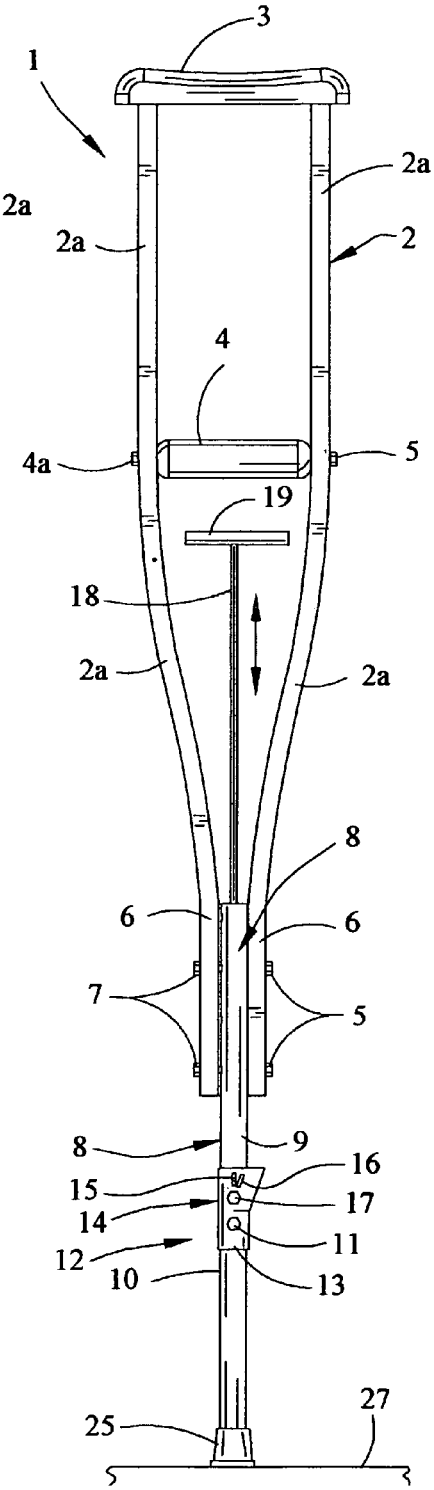
FIG. 2 is a side view of the stair-adjustable crutch with the crutch foot configured in aligned configuration for conventional use of the crutch on a flat or level surface.

Referring initially to FIGS. 1-4 of the drawings in a preferred embodiment, the stair-adjustable crutch of this invention is generally illustrated by reference numeral 1. The stair-adjustable crutch 1 includes a crutch frame 2, which may be conventional in configuration, with frame members 2*a* spaced apart intermediately by a grip 4 and at the top by an arm support 3. The frame members 2*a* are terminated at the bottom by a pair of parallel frame legs 6. A bisected crutch foot 8 defines an upper foot end 9 and a lower foot end 10 and the upper foot end 9 extends between the parallel frame legs 6 in selectively fixed or adjustable relationship. Frame leg bolts 7 typically extend through aligned openings (not illustrated) in the parallel frame legs 6 and through the corresponding foot openings 8*a* (FIG. 4) in the upper foot end 9 of the crutch foot 8, and are typically secured by nuts 5 (FIG. 2). An adjusting cuff 12 is fitted in the bisected crutch foot 8 and receives the upper foot end 9 and lower foot end 10 of the crutch foot 8, as hereinafter described. A rubber friction cup 25 is typically fitted to the lower end of the lower foot end 10 for friction-enhancing purposes during use of the stair-adjustable crutch 1.

Figure 3:
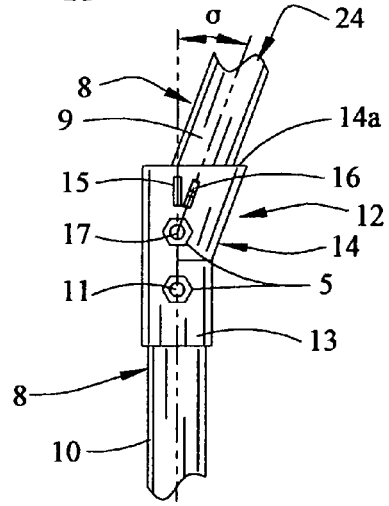
FIG. 3 is a side view, partially in section, of the hollow crutch foot and adjusting cuff elements of the stair-adjustable crutch illustrated in FIG. 1, more particularly illustrating the angulated configuration of the upper crutch foot in the adjusting cuff.
Figure 4:
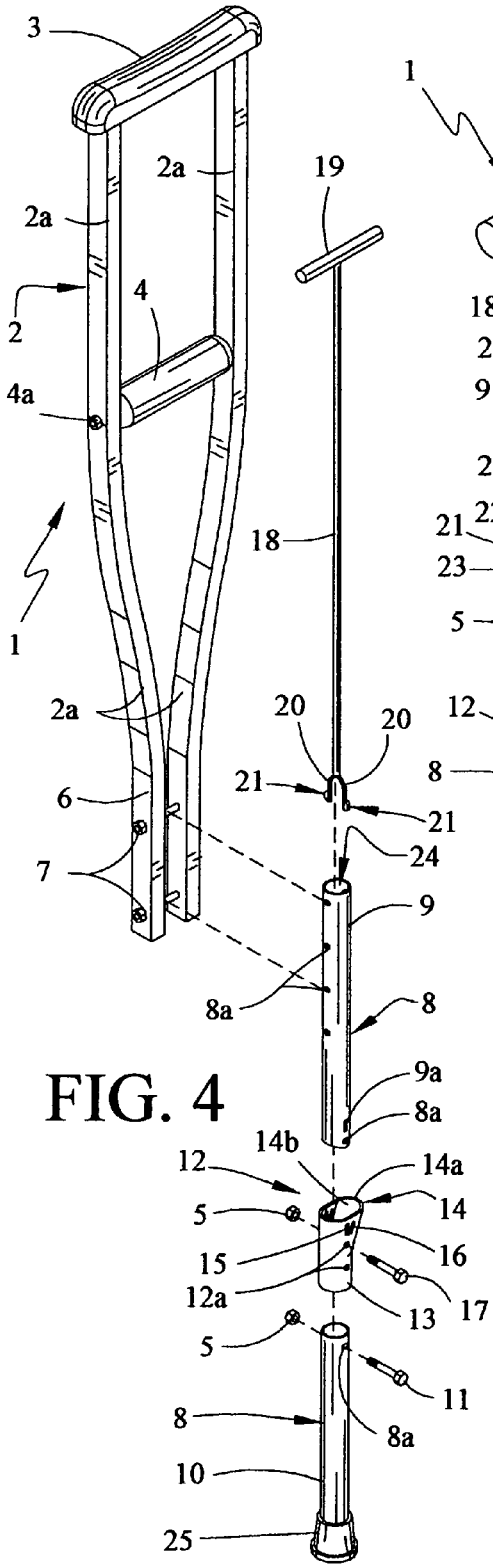
FIG. 4 is an exploded view of the stair-adjustable crutch illustrated in FIG. 2.

Referring again to FIGS. 1-4, the adjusting cuff 12 is further characterized by a generally cylindrical cuff bottom 13 that is fixed to the lower foot end 10 of the crutch foot 8, typically by means of a transverse lower foot end pin or bolt 11, extending through a cuff opening 12*a* in the cuff bottom 13, and secured by a nut 5 (FIG. 4). An irregularly-shaped cuff cone 14 extends upwardly from the cuff bottom 13 and projects outwardly along one perimeter segment in offset, extended and flared fashion, to define an elongated lip 14*a* and a corresponding lip receptacle 14*b* (FIG. 4), for optionally accommodating the upper foot end 9 in a pivoted and angular orientation, as hereinafter further described. A pair of oppositely-disposed, aligned cone slots 15 is provided in the non-offset and elongated portion or segment of the cuff cone 14, while a pair of oppositely-disposed angled cone slots 16 is provided in the flared and offset portion of the cuff cone 14, below the elongated lip 14*a* and communicating with the elongated lip receptacle 14*b*, as illustrated in FIGS. 3 and 4. A crutch pivot pin or bolt 17 extends transversely through a second cuff opening 12*a* provided in the cuff cone 14 and the upper foot end 9 of the crutch foot 8 and is typically secured by a nut 5, to pivotally secure the upper foot end 9 and the crutch frame 2 on the cuff cone 14 above the lower foot end 10.

Figure 5:
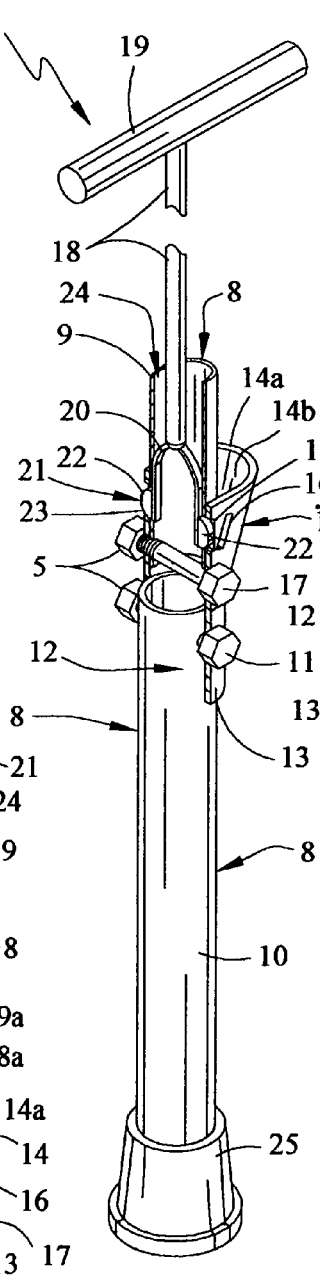
FIG. 5 is a longitudinal sectional view of the adjustable cuff and upper crutch foot elements of the stair-adjustable crutch, more particularly illustrating shaped locks provided on a pair of rod legs extending from an adjusting rod projecting through the upper crutch foot, for engaging a first set of spaced-apart slots to configure the stair-adjustable crutch as illustrated in FIG. 2.

Referring now to FIGS. 2 and 4-6 of the drawings a stiff adjusting rod 18 extends from immediately beneath the grip 4 of the stair-adjustable crutch 1, longitudinally downwardly and typically slidably through a longitudinal bore or opening 24 (FIG. 4) in the crutch foot 8 and terminates above or in the cuff cone 14. A rod handle 19 is typically provided on the upper end of the adjusting rod 18, beneath and spaced from the grip 4 for manipulating the adjusting rod 18 up and down, as further illustrated in FIG. 2. A pair of resilient, typically wishbone-shaped rod legs 20 diverge from the downwardly-extending end of the adjusting rod 18 and terminate in corresponding oppositely-disposed, spaced-apart, fixed tabs or locks 21 (FIGS. 4 and 5). Each of the locks 21 is characterized by a top curve or taper 22 and may have a bottom curve or taper 23 (FIG. 5) for seating in a corresponding lock slot 9*a* (FIGS. 4, 8 and 9) in the upper foot end 9 and selectively engaging the oppositely-disposed, aligned cone slots 15 and the angled cone slots 16 provided in the cuff cone 14, for purposes which will be hereinafter further described. The rod legs 20 are typically constructed of a metal or plastic material having sufficient resilience and memory to exert an outward force on the inside surface of the cuff cone 14 and the lock slots 9*a* by each of the oppositely-disposed locks 21, responsive to linear manipulation of the adjusting rod 18 when gripping the rod handle 19, as illustrated in FIGS. 5, 6, 8 and 9 of the drawings and as further hereinafter described.

Figure 10:
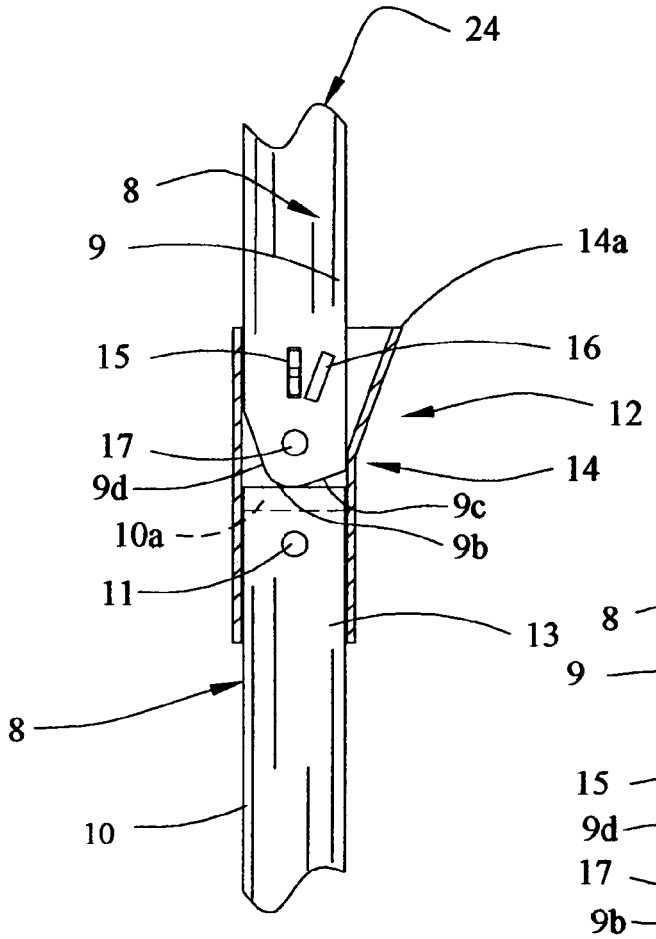
FIG. 10 is a side sectional view of the cuff cone, more particularly illustrating an alternative bevelled embodiment of the upper foot end of the crutch foot in aligned configuration with respect to the lower foot end.
Figure 11:
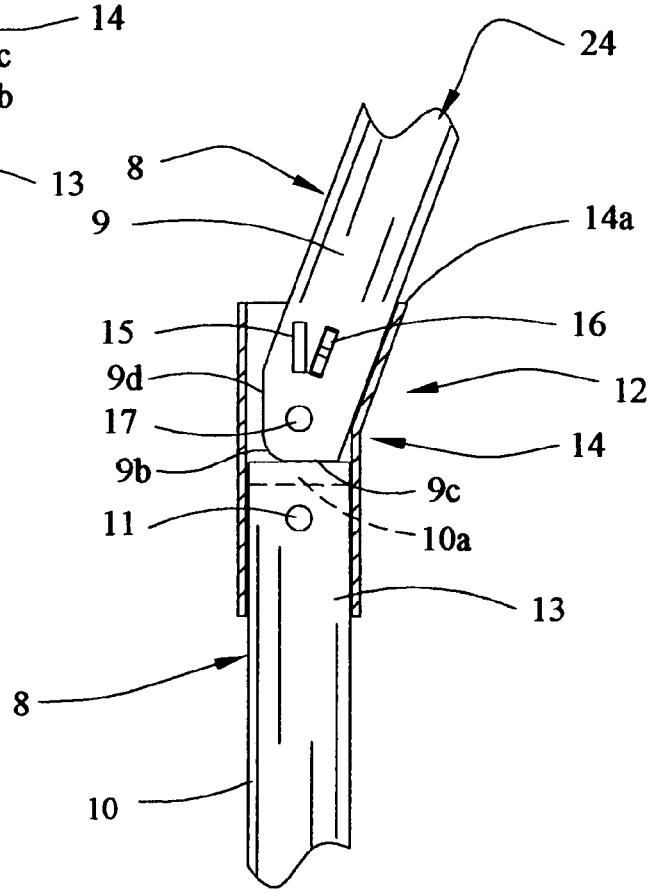
FIG. 11 is a side sectional view of the cuff cone illustrated in FIG. 10, illustrating the alternative bevelled upper foot end embodiment wherein the upper foot end is angulated with respect to the lower foot end of the crutch foot.

Referring now to FIGS. 10 and 11 of the drawings, in an alternative configuration of the stair-adjustable crutch 1, the bottom end of the upper foot end 9 of the crutch foot 8 is shaped to define a forward bevel 9*c* and a rear bevel 9*d*, that converge to a fulcrum 9*b*. Additional vertical support is thus provided in the crutch foot 8 as the fulcrum 9*b* contacts a plug 10*a* (illustrated in phantom) or the solid end of the lower foot end 10, as illustrated in FIG. 10. Support of the crutch foot 8 is also provided in the angulated configuration illustrated in FIG. 11, as the forward bevel 9*c* contacts the plug 10*a* or the solid end of the lower foot end 10, as illustrated. This embodiment serves to reduce the shear forces on the crutch pivot bolt 17.

Figure 6:
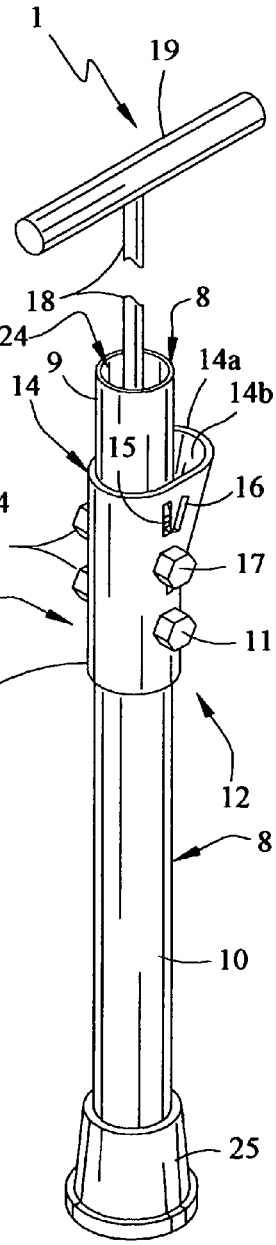
FIG. 6 is a perspective view, partially in section, of the lower section of the stair-adjustable crutch, including the adjusting cuff, more particularly illustrating the locked configuration illustrated in FIG. 5.

In operation, referring to FIGS. 1, 2 and 5-9 of the drawings, under circumstances where it is desired to use the stair-adjustable crutch I in the conventional upright configuration illustrated in FIGS. 2, 5, 6 and 10, the adjusting rod 18 is initially forced upwardly by gripping the rod handle 19. This action bends and moves the spaced-apart rod legs 20 upwardly inside the cuff cone 14 and disengages the locks 21 from the oppositely-disposed lock slots 9*a* (FIG. 9) to facilitate positioning the crutch frame 2 and the upper foot end 9 into linear alignment with the lower foot end 10 (FIG. 2 ). The adjusting rod 18 is then forced downwardly by pressure applied to the rod handle 19 to facilitate re-engagement of the shaped locks 21 with the companion lock slots 9*a* and with the registering oppositely-disposed, aligned cone slots 15 at the curved or bevelled bottom taper 23 and locking of the lower foot end 10 of the crutch foot 8 to the upper foot end 9 (FIGS. 5 and 6). The stair-adjustable crutch 1 is then utilized to traverse a typically flat or level surface 27 in conventional, upright configuration, as illustrated in FIG. 2.

Figure 9:
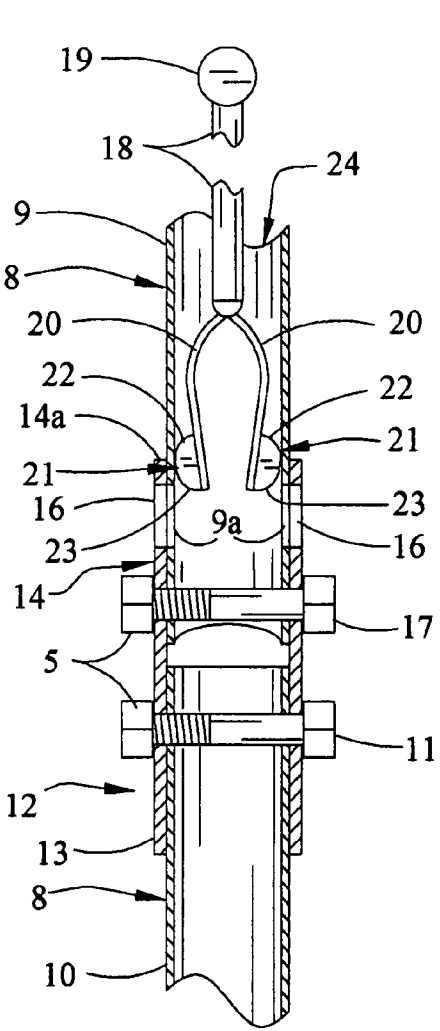
FIG. 9 is a longitudinal sectional view of the crutch foot and cuff cone of the stair-adjustable crutch illustrated in FIG. 8, more particularly illustrating bending of the resilient rod legs inwardly inside the adjusting cuff by manipulation of the adjusting rod to facilitate insertion of the corresponding locks in the lock slots in the crutch foot and the angulated second set of slots in the adjusting cuff for selectively configuring the stair-adjustable crutch as illustrated in FIGS. 1 and 2 of the drawings.
Figure 8:
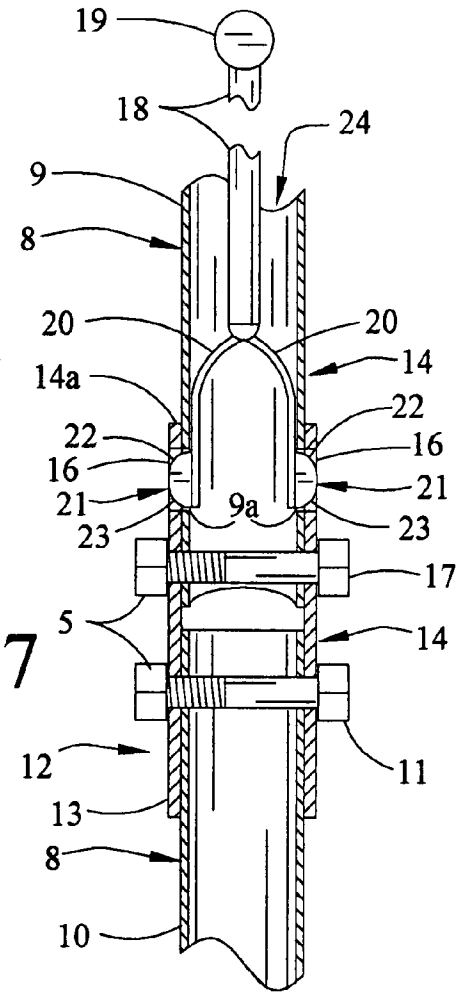
FIG. 8 is a longitudinal sectional view of the crutch foot and cuff cone, more particularly illustrating the stair-adjustable crutch adjusting cuff and foot configured as illustrated in FIGS. 1, 3 and 7.

Alternatively, when it is desired to utilize the stair-adjustable crutch 1 to ascend a set of steps or stairs 28 as indicated in FIG. 1, the adjusting rod 18 is again manipulated upwardly by gripping the rod handle 19 to disengage the respective locks 21 from the opposed companion lock slots 9*a* and the corresponding spaced-apart, aligned cone slots 15, due to the top taper 22, as illustrated in FIG. 9. The crutch frame 2 and upper foot end 9 of the crutch foot 8, as well as the lock slots 9*a*, are then pivoted into the configuration illustrated in FIGS. 1, 3, 7, 8 and 11, with the upper foot end 9 disposed at an angle (alpha) (FIG. 3) with respect to the lower foot end 10 and resting in the elongated lip receptacle 14*b* of the angled, flared or offset cuff cone 14. The lock slots 9*a* and angled cone slots 16 are thusly aligned and downward motion or movement of the adjusting rod 18 pursuant to pressure applied to the rod handle 19 then engages the respective locks 21 with the lock slots 9*a* and the corresponding oppositely-disposed angled cone slots 16 (FIGS. 1 and 8), to lock the crutch frame 2 in angular relationship with respect to the lower foot end 10 of the crutch foot 8, as illustrated in FIG. 1. Using the stair-adjustable crutch 1 as so oriented, a user (not illustrated) can ascend the steps or stairs 28 (illustrated in phantom) with the body weight further forward than is possible under circumstances where the stair-adjustable crutch 1 is utilized in the conventional upright configuration illustrated in FIG. 2. This angulation increases the confidence level of the user regarding weight distribution and promotes efficiency, path-dependent stability and safety while ascending the steps or stairs 28.

Figure 7:
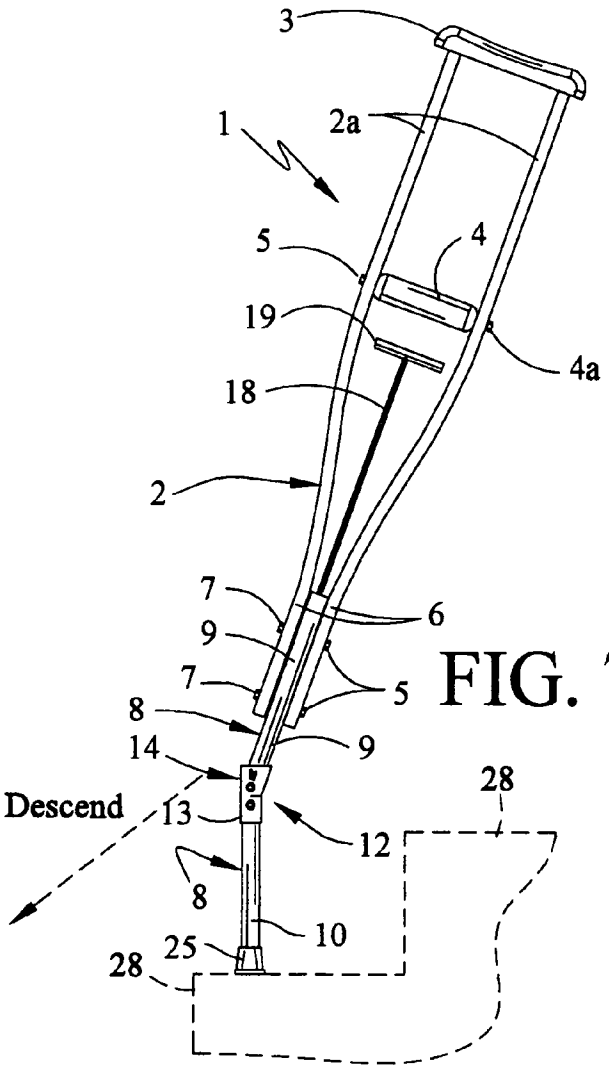
FIG. 7 is a side view of the stair-adjustable crutch illustrated in FIG. 1, with the stair-adjustable crutch oriented in stair or step-descending configuration.

Under circumstances where the steps or stairs 28 are to be descended as illustrated in FIG. 7, the position of the stair-adjustable crutch 1 is again oriented in the position illustrated in FIG. 1, such that the user's weight distribution is rearwardly of the angled lower foot end 10 of the crutch foot 8, thus again increasing confidence in the ability of the user to descend the steps or stairs 28 in a more efficient stable and safe manner.

It will be appreciated by those skilled in the art that the stair-adjustable crutch of this invention is characterized by convenience and flexibility, in that the respective stair and step ascending and descending modes, as well as use on level or substantially flat ground, can be effected quickly and may be easily implemented by application of upward and downward pressure to the rod handle of the adjusting rod, as heretofore described. Furthermore, the stair-adjustable crutch can be utilized in conventional fashion as further heretofore described, without the necessity of utilizing the foot angulation feature. Moreover, the stair-adjusting crutch is user-friendly, in that it can be utilized by large and small children as well as adults, by simply manipulating the adjusting rod by applying pressure to the rod handle, as heretofore described. Still further, the stair-adjustable crutch can be utilized singularly or in pairs, depending upon the needs of the user and either or both crutches can be adjusted in the appropriate fashion as described above, in order to walk on level ground or to ascend or descend set of steps or stairs, as heretofore described.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above,

What is claimed is:

1. A stair-adjustable crutch comprising a crutch frame: a crutch foot having a top segment carried by said crutch frame and a bottom segment; an adjusting cuff fixed to said bottom segment of said crutch foot; a first pair of spaced-apart cone slots provided in said adjusting cuff in substantial alignment with said bottom segment of said crutch foot; a second pair of spaced-apart cone slots provided in said adjusting cuff in angular relationship with respect to said first pair of spaced-apart cone slots; an adjusting rod removably engaging said adjusting cuff; a pair of spaced-apart resilient rod legs extending from said adjusting rod into said adjusting cuff; and a pair of shaped locks provided on said rod legs for engaging said first pair of spaced-apart cone slots when said top segment and said crutch frame are positioned in alignment with said bottom segment and said locks selectively engaging said second pair of spaced-apart cone slots when said top segment and said crutch frame are positioned in angular relationship with respect to said bottom segment of said crutch foot.

2. The stair-adjustable crutch of claim 1 comprising a handle provided on said adjusting rod for slidably manipulating said adjusting rod in said crutch foot and said rod legs in said adjusting cuff and said locks selectively in said first pair of spaced-apart cone slots and said second pair of spaced-apart cone slots, respectively.

3. A stair-adjustable crutch comprising a crutch frame; a crutch foot having a top segment provided in said crutch frame and a bottom segment; an adjusting cuff having a cuff cone and a cuff bottom, said cuff bottom fixed to said bottom segment of said crutch foot and said cuff cone pivotally receiving said top segment of said crutch foot; an adjusting rod slidably extending through said top segment of said crutch foot and terminating at said cuff cone of said adjusting cuff; a first pair of spaced-apart cone slots provided in said cuff cone in substantially aligned relationship with respect to said bottom segment of said crutch foot; a second pair of spaced-apart cone slots provided in said cuff cone in angular relationship with respect to said first pair of spaced-apart cone slots; a pair of spaced-apart, resilient rod legs extending from said adjusting rod inside said cuff cone; and a pair of shaped locks provided on said rod legs, respectively, for engaging said first pair of spaced-apart cone slots when said top segment of said crutch foot and said crutch frame are positioned in alignment with said bottom segment of said crutch foot and said locks engaging said second pair of spaced-apart cone slots when said top segment of said crutch foot and said crutch frame are positioned in angular relationship with respect to said bottom segment of said crutch foot, responsive to manipulation of said adjusting rod.

4. The stair-adjustable crutch of claim 3 comprising a handle provided on said adjusting rod for slidably manipulating said adjusting rod and said rod legs in said crutch foot and said locks selectively into and from said first pair of spaced-apart cone slots and said second pair of spaced-apart cone slots, respectively.

5. The stair-adjustable crutch of claim 3 comprising at least one bevel provided on the bottom of said top segment of said crutch foot, said bevel defining a fulcrum for engaging the top end of said lower foot end and stabilizing said crutch foot.

6. The stair-adjustable crutch of claim 5 comprising a handle provided on said adjusting rod for slidably manipulating said adjusting rod and said rod legs in said crutch foot and said locks selectively into and from said first pair of spaced-apart cone slots and said second pair of spaced-apart cone slots, respectively.

7. A stair-adjustable crutch comprising a crutch frame; a crutch foot having a top segment extending from said crutch frame, a fulcrum and a bevel shaped in the bottom end of said top segment and a bottom segment; an adjusting cuff having a cuff cone and a cuff bottom, said cuff bottom fixed to said bottom segment of said crutch foot and said cuff cone pivotally receiving said top segment of said crutch foot; a flared segment provided in said cuff cone; an adjusting rod slidably disposed with respect to said crutch frame, said adjusting rod terminating at said cuff cone of said adjusting cuff; a first pair of spaced-apart cone slots provided in said cuff cone in substantially aligned relationship with respect to said bottom segment of said crutch foot; a second pair of spaced-apart cone slots provided in said flared segment in said cuff cone in angular relationship with respect to said first pair of spaced-apart cone slots; a pair of spaced-apart, resilient rod legs extending from said adjusting rod inside said cuff cone of said adjusting cuff; and a pair of locks provided on said rod legs, respectively, for engaging said first pair of spaced-apart cone slots when said top segment of said crutch foot and said crutch frame are positioned in alignment with said bottom segment of said crutch foot and said fulcrum engages said bottom segment in a first selected crutch configuration and said locks engaging said second pair of spaced-apart cone slots when said top segment of said crutch foot and said crutch frame are positioned in angular relationship with respect to said first pair of spaced-apart cone slots and said bottom segment of said crutch frame, said bevel engages said bottom segment and said top segment of said crutch foot is seated in said flared segment of said cuff cone in a second selected crutch configuration, responsive to said manipulation of said adjusting rod.

8. The stair-adjustable crutch of claim 7 comprising a handle provided on said adjusting rod for selectively slidably manipulating said adjusting rod and said rod legs in said cuff cone and said locks into and from said first pair of spaced-apart cone slots and said second pair of spaced-apart cone slots, respectively.

9. The stair-adjustable crutch of claim 7 comprising an opening or bore provided in said top segment of said crutch foot and wherein said adjusting rod extends through said bore to said cuff cone of said adjusting cuff.

10. The stair-adjustable crutch of claim 9 comprising a handle provided on said adjusting rod for selectively slidably manipulating said adjusting rod and said rod legs in said cuff cone and said locks into and from said first pair of spaced-apart cone slots and said second pair of spaced-apart cone slots, respectively.

11. The stair-adjustable crutch of claim 7 wherein said bottom segment of said crutch foot is hollow and comprising a plug or cap provided at least on the top end of said bottom segment of said crutch foot for engaging said fulcrum and said bevel, respectively.

12. The stair-adjustable crutch of claim 11 comprising a handle provided on said adjusting rod for selectively slidably manipulating said adjusting rod and said rod legs in said cuff cone and said locks into and from said first pair of spaced-apart cone slots and said second pair of spaced-apart cone slots, respectively.

13. The stair-adjusting crutch of claim 12 comprising an opening or bore provided in said top segment of said crutch foot and wherein said adjusting rod extends through said bore to said cuff cone of said adjusting cuff.

14. A method for angularly adjusting a crutch frame and an upper crutch foot attached to the crutch frame with respect to the lower crutch foot, comprising the steps of providing an adjusting cuff on the lower crutch foot; providing a fulcrum and a bevel on the bottom end of the upper crutch foot; providing a cone having an elongated, flared lip with a lip receptacle on the adjusting cuff pivotally mounting the upper crutch foot in the cone at the lip and lip receptacle; and providing a locking mechanism that selectively engages the cone and facilitates selective operation of the crutch with said fulcrum selectively engaging the top end of the lower crutch foot when the upper crutch foot is in alignment with the lower crutch foot in a first crutch-operating configuration and with said bevel selectively disengaging the top end of the lower crutch foot when the upper crutch foot is in misalignment with said lower crutch foot and the upper crutch foot is pivotally disposed in the cone against the lip receptacle in a second crutch-operating configuration.

15. The method of claim 14 comprising the step of providing a first pair of spaced-apart cone slots in said cone for receiving the locking mechanism and positioning the upper crutch foot in said alignment with the lower crutch foot in said first crutch-operating configuration and a second pair of spaced-apart cone slots in the flared lip of the cone for receiving the locking mechanism and positioning the upper crutch foot in said misalignment with the lower crutch foot in said second crutch-operating configuration.

16. The method of claim 15 comprising the step of providing a pair of locks in the locking mechanism for selectively engaging the first pair of spaced-apart cone slots and the second pair of spaced-apart cone slots, respectively.

17. The method of claim 14 comprising the step of closing the top end of the lower crutch foot for engaging the fulcrum and the bevel, respectfully.

* * * * *